US006483489B1

(12) United States Patent
Yoo et al.

(10) Patent No.: US 6,483,489 B1
(45) Date of Patent: Nov. 19, 2002

(54) RADIO FREQUENCY DRIVING CIRCUIT OF PLASMA DISPLAY PANEL AND METHOD OF SWITCHING THE SAME

(75) Inventors: Yeun Ho Yoo, Koyang Kyunggi-do (KR); Jeong Pil Choi, Suwon Kyunggi-do (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 09/525,907

(22) Filed: Mar. 15, 2000

(30) Foreign Application Priority Data

Mar. 16, 1999 (KR) ..... 99-8842
Mar. 16, 1999 (KR) ..... 99-8844
Apr. 9, 1999 (KR) ..... 99-12539

(51) Int. Cl.[7] ..... G09G 3/28
(52) U.S. Cl. ..... 345/60; 345/68
(58) Field of Search ..... 345/67, 68, 55, 345/60; 315/169.4

(56) References Cited

U.S. PATENT DOCUMENTS 5,512,915 A * 4/1996 Leroux ..... 345/55
5,835,072 A * 11/1998 Kanazawa ..... 345/60
5,867,135 A * 2/1999 Salavin et al. ..... 345/68
6,340,866 B1 * 1/2002 Yoo ..... 315/169.3

* cited by examiner

*Primary Examiner*—Steven Saras
*Assistant Examiner*—Michael J. Moyer
(74) *Attorney, Agent, or Firm*—Fleshner & Kim, LLP

(57) ABSTRACT

A radio frequency driving circuit and a radio frequency signal switching method that are capable of easily controlling a radio frequency signal in a radio frequency plasma display panel. In the method, a turning-on signal is applied before the radio frequency signal is completely erased by applying a turning-off signal to a radio frequency generator. Accordingly, a rising time of the radio frequency signal is reduced, so that the radio frequency signal can be switched to be suitable for the PDP driving.

11 Claims, 10 Drawing Sheets

RADIO FREQUENCY DRIVING CIRCUIT OF PLASMA DISPLAY PANEL AND METHOD OF SWITCHING THE SAME

BACKGROUND OF THE INVENTION

1. Field of the Invention

This invention relates to a plasma display panel (PDP), and more particularly to a radio frequency driving circuit and a switching method thereof that are capable of switching a radio frequency signal to be adaptive for a radio frequency PDP driving.

2. Description of the Related Art

Recently, a plasma display panel (PDP) feasible to the fabrication of large-scale panel has been available for a flat panel display device. The PDP includes discharge cells corresponding to color pixels of matrix type and controls a discharge interval of each discharge cell to display a picture. More specifically, after the PDP selected discharge cells to be displayed by an address discharge, it allows a discharge to be maintained in a desired discharge interval at the selected discharge cells. Thus, in the discharge cells, a vacuum ultraviolet ray generated during the sustaining discharge radiates a fluorescent material to emit a visible light. In this case, the PDP controls a discharge-sustaining interval, that is, a sustaining discharge frequency of the discharge cells to implement a gray scale required for an image display. As a result, the sustaining discharge frequency becomes an important factor for determining the brightness and a discharge efficiency of the PDP. For the purpose of performing such a sustaining discharge, a sustaining pulse having a frequency of 200 to 300 kHz and a width of about 10 to 20 $\mu$s has been used in the prior art. However, the sustaining discharge is generated only once at a extremely short instant per the sustaining pulse by responding to the sustaining pulse; while it is wasted for a step of forming a wall charge and a step of preparing the next sustaining discharge at the remaining major time. For this reason, the conventional three-electrode, face-discharge, and AC PDP has a problem in that, since a real discharge interval is very short in comparison to the entire discharge interval, the brightness and the discharge efficiency become low.

In order to solve such a problem of low brightness and low discharge efficiency, we has suggested a method of utilizing a radio frequency discharge employing a radio frequency signal of hundreds of MHz as a display discharge. In the case of the radio frequency discharge, electrons perform an oscillating motion by the radio frequency signal to sustain the display discharge in a time interval when the radio frequency signal is being applied. More specifically, when a radio frequency signal with a continuously alternating polarity is applied to any one of the two opposite electrodes, electrons within the discharge space are moved toward one electrode or the other electrode depending on the polarity of the voltage signal. If the polarity of a radio frequency voltage signal having been applied to the electrode before the electrons arrive at the electrode is changed when electrons are moved into any one electrode, then the electrons has a gradually decelerated movement speed in such a manner to allow their movement direction to be changed toward the opposite electrode. The polarity of the radio frequency voltage signal having been applied to the electrode before the electrons within the discharge space arrive at the electrode is changed as described, so that the electrons make an oscillating motion between the two electrodes. Accordingly, when the radio frequency voltage signal is being applied, the ionization, the excitation and the transition of gas particles are continuously generated without extinction of electrons. The display discharge is sustained during most discharge time, so that the brightness and the discharge efficiency of the PDP can be improved. Such a radio frequency discharge has the same physical characteristic as a positive column in a glow discharge structure.

FIG. 1 is a perspective view showing the structure of a discharge cell of the above-mentioned radio frequency PDP employing a radio frequency discharge. In FIG. 1, the discharge cell 26 includes radio frequency electrodes 12 provided on an upper substrate 10, data electrodes 16 and scanning electrodes 20 provided on a lower substrate 14 in such a manner to be perpendicular to each other, and barrier ribs 22 provided between the upper substrate 10 and the lower substrate 14. The radio frequency electrodes 12 apply a radio frequency signal. The data electrodes 16 apply a data pulse for selecting cells to be displayed. The scanning electrodes 20 are provided in opposition to the radio frequency electrodes 12 in such a manner to be used as opposite electrodes of the radio frequency electrodes 12. Between the data electrodes 16 and the scanning electrodes 20 is provided a dielectric layer 18 for the charge accumulation and the isolation. The barrier ribs 22 shut off an optical interference between the cells. In this case, the barrier ribs 22 are formed into a lattice structure closed on every side for each discharge cell so as to isolate the discharge space. This is because it is difficult to isolate a plasma for each cell unlike the existent face-discharge due to the opposite discharge generated between the radio frequency electrodes 12 and the scanning electrodes 20. Also, the barrier ribs 22 have a more enlarged height than the conventional barrier ribs for the sake of providing a smooth radio frequency discharge between the scanning electrodes 20 and the radio frequency electrodes 12. A fluorescent material 24 is coated on the surface of the barrier rib 22 to emit a visible light with an inherent color by a vacuum ultraviolet ray generated during the radio frequency discharge. The discharge space defined by the upper substrate 10, the lower substrate 14 and the barrier ribs 22 is filled with a discharge gas.

As shown in FIG. 2, the discharge cells 26 having the configuration as described above are positioned at each intersection among data electrode lines X1 to Xm, scanning electrode lines Y1 to Yn and radio frequency electrode lines RF. In FIG. 2, the data electrode lines X1 to Xm consist of the data electrodes 16 of the discharge cells 26. The scanning electrode lines Y1 to Yn consist of the scanning electrodes 20, and the radio frequency electrode lines RF consist of radio frequency electrodes 12.

The discharge cell 26 of FIG. 1 is driven a driving waveform as shown in FIG. 3. A radio frequency pulse RFP more than tens of MHz is continuously applied to the radio frequency electrode 12. At an A region in which a data pulse DP is applied to the address electrode 16 and a scanning pulse SP is applied to the scanning electrode 20, an address discharge is generated by the voltage difference Vd+Va. By this address discharge, charged particles are produced at the discharge space. These charged particles make a radio frequency discharge by a radio frequency pulse RFP applied to the radio frequency electrode 12 and a center voltage Vc of a radio frequency voltage applied constantly to the scanning electrode 20. In this case, an ultraviolet ray generated by the radio frequency discharge radiates the fluorescent material 24 to emit a visible light. At a C region in which an erasing pulse EP is applied to the scanning electrode 20, the charged particles are vanished by an erasure voltage Ve to stop the radio frequency discharge.

As described above, the conventional radio frequency PDP applies the radio frequency signal continuously to thereby initiate the radio frequency discharge by the charged particles produced by the address discharge and the radio frequency signal and stop the radio frequency discharge by the erasure pulse EP. The gray scale is implemented by differently setting a time at which the erasure pulse EP is applied to control the radio frequency discharge interval, that is, the discharge-sustaining interval. If the radio frequency signal is continuously applied in the remaining interval except for the radio frequency discharge interval, however, then problems such as signal interference, noise and miss-discharge, etc. may be generated. In order to prevent these problems, it is necessary to switch the radio frequency signal to provide it only in the radio frequency discharge interval. However, it is difficult to switch the radio frequency signal requiring more than hundreds of volt (V), for the sake of providing the radio frequency discharge, at a rapid time rate such as the radio frequency discharge interval.

More specifically, a radio frequency circuit of the PDP for switching a radio frequency signal can be configured as shown in FIG. 4. Referring to FIG. 4, the radio frequency circuit includes a radio frequency generator 30 for generating a radio frequency signal, an amplifier 34 for amplifying the radio frequency signal from the radio frequency generator 30, and an impedance matcher 37 connected between the amplifier 34 and a panel 38. The radio frequency generator 30 generates a low level of radio frequency pulse and outputs it to the amplifying unit 35. The amplifying unit 35 consists of the amplifier 34 and a peak detector 36. The amplifying unit 35 amplifies the radio frequency pulse from the radio frequency generator 30 into a power required for the radio frequency discharge and output it. The peak detector 36 detects a peak-to-peak value PPrf from the radio frequency pulse from the amplifier 34 and feeds it back into the amplifier 34 thereby allowing the amplifier 34 to amplify and output the radio frequency pulse into a certain power. The impedance matcher 37 matches an impedance at the output terminal of the amplifying unit 35 with an impedance of the panel 38, thereby applying a maximum power of radio frequency signal to the radio frequency electrode 12. Generally, an incident wave and a reflective wave co-exist in the radio frequency circuit, and a power superposed with the incident wave and the reflective wave is applied to the radio frequency electrode 12 of the panel 38. Thus, to apply a maximum power by the impedance matching means to allow an incident wave to be applied to the radio frequency electrode 12 as it is by a minimization of a reflective wave.

The switch 32 switches the radio frequency signal from the radio frequency generator 30 in accordance with a switching signal SWS, as shown in FIG. 5, inputted via an input line 31. Referring to FIG. 5, the switch 32 is turned off in address intervals (AP1, AP2, AP3, . . . ) of each sub-field (SF1, SF2, SF3, . . . ) at which the input switching signal SWS has a low level to thereby shut off the radio frequency pulse from the radio frequency generator 30. On the other hand, the switch 32 is turned on only in discharge-sustaining intervals (SP1, SP2, SP3, . . . ) of each sub-field (SF1, SF2, SF3, . . . ) at which the input switching signal SWS has a high level to thereby apply the radio frequency pulse from the radio frequency generator 30 to the amplifier 34. In this case, the switch 32 must generate a radio frequency signal in a soft start manner so as to assure a safety of the entire PDP system. This is because of a damage of circuit caused by a rush current when a high voltage of radio frequency signal is rapidly generated. Accordingly, the switch 32 has to slowly increase the radio frequency voltage in a range in which the rush current is minimized. In such a soft start method, however, a time of at least tens of to hundreds of $\mu$s is wasted for a rising time until the radio frequency signal arrives at a normal level.

As described above, in the conventional radio frequency signal switching method, a considerably long time is wasted for a rising time when the radio frequency signal is increased into a normal level required for the radio frequency discharge after the generation thereof. Accordingly, the radio frequency discharge interval is relatively shortened to have a bad influence on the guarantee of display time regarded as a most important factor in the PDP. In other words, the conventional radio frequency signal switching method is not applicable to a PDP required to switch a radio frequency signal within a very short time for the purpose of an implementation of gray scale as it is.

SUMMARY OF THE INVENTION

Accordingly, it is an object of the present invention to provide a radio frequency driving circuit and a radio frequency signal switching method thereof that is capable of sufficiently assuring a radio frequency discharge interval by switching a radio frequency signal in a rapid time interval suitably for a PDP driving.

A further object of the present invention is to provide a radio frequency driving circuit and a radio frequency signal switching method thereof that is capable of stably driving a PDP employing a radio frequency signal by switching the radio frequency signal to apply the same to a panel only in a display interval.

In order to achieve these and other objects of the invention, a method of switching a radio frequency signal in a plasma display panel according to one aspect of the present invention includes applying a turning-on signal before the radio frequency signal is completely erased by applying a turning-off signal to a radio frequency generator, thereby generating the radio frequency signal.

A driving circuit for a plasma display panel according to another aspect of the present invention includes radio frequency generating means for generating a radio frequency signal; and impedance matching means for matching an impedance of the radio frequency generating means with that of the plasma display panel and varying the matched impedance to switch the radio frequency signal.

A method of switching a radio frequency signal in a plasma display panel employing the radio frequency discharge according to still another aspect of the present invention includes controlling a power level of the radio frequency signal applied to the plasma display panel to switch the radio frequency signal.

A driving circuit for a plasma display panel according to still another aspect of the present invention includes radio frequency generating means for generating a radio frequency signal to apply it to a radio frequency electrode of the plasma display panel; and switching means connected between other electrode of the plasma display panel connected to a ground line of the radio frequency generating means and the ground line to be switched in accordance with said interval of the radio frequency discharge, thereby controlling a power level of the radio frequency signal applied to the radio frequency electrode.

A method of controlling a plasma display panel device according to still another aspect of the present invention wherein an address discharge for selecting cells to be displayed is made by a current voltage applied to crossing electrodes while a sustaining discharge for sustaining said discharge of the selected cells to provide a display is made by a radio frequency voltage, includes turning on or off said radio frequency voltage with a switching pulse to be turned on only in the sustaining-discharge interval; and applying turning-on signal before the radio frequency signal is completely erased by applying a turning-off signal.

BRIEF DESCRIPTION OF THE DRAWINGS

These and other objects of the invention will be apparent from the following detailed description of the embodiments of the present invention with reference to the accompanying drawings, in which.

DETAILED DESCRIPTION OF THE PREFERRED EMBODIMENT

Figure 6:
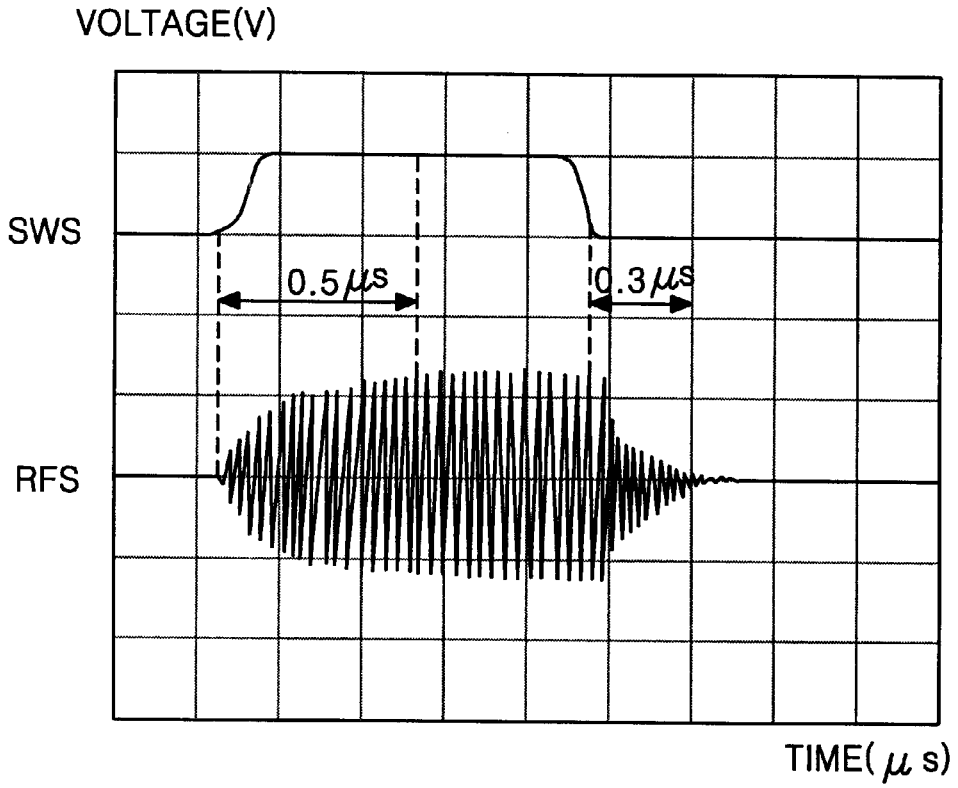
FIG. 6 is a waveform diagram of a radio frequency signal generated by the conventional radio frequency switching signal.
Figure 7:
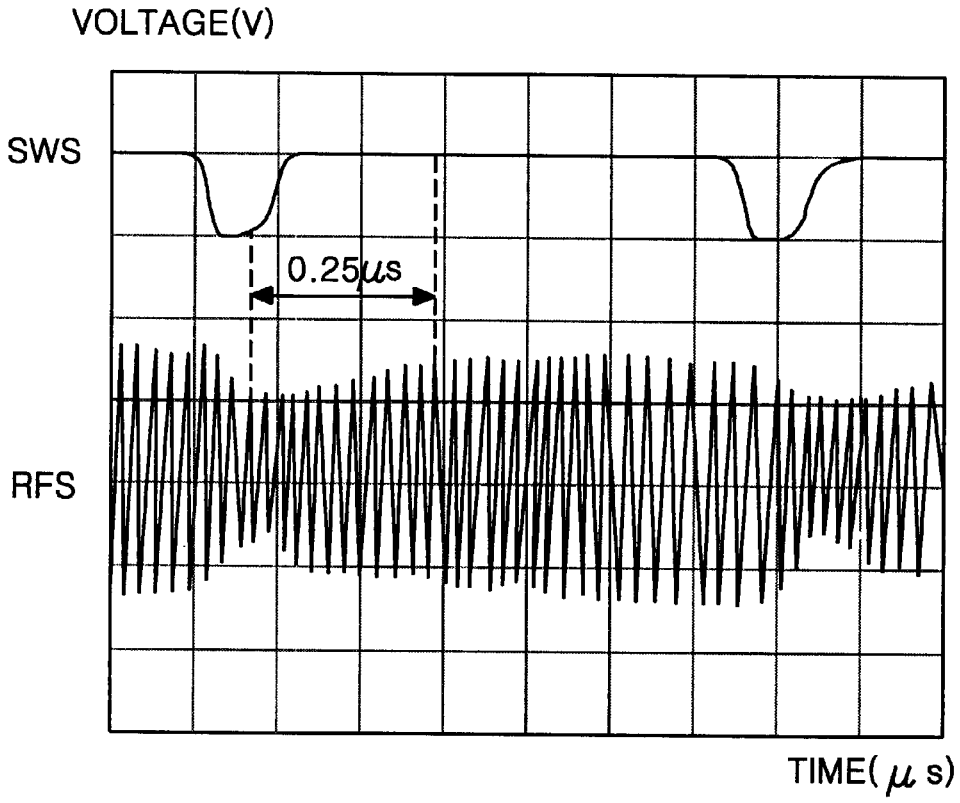
FIG. 7 is a waveform diagram of a radio frequency signal generated by a radio frequency switching signal according to an embodiment of the present invention.

Referring to FIG. 6 and FIG. 7, there are shown switching signals SWS and radio frequency signals RFS that are experimentally obtained for the purpose of comparing the conventional radio frequency signal switching method with a radio frequency signal switching method according to an embodiment of the present invention. In FIG. 6, when a high level of turn-on signal is applied as the switching signal SWS in a state in which the radio frequency signal RFS is completely turned off, about 0.5 $\mu$s is required for a rising time increasing from the generation of the radio frequency signal RFS into a normal state thereof. Also, about 0.3 $\mu$s is required for a falling time until the normal state of radio frequency signal REF is completely disappeared by a turn-off signal having a low level. On the other hand, in the radio frequency switching method according to an embodiment of the present invention as shown in FIG. 7, a rising time of the radio frequency signal RFS can be reduced by applying a turn-on signal before the radio frequency signal REF is completely disappeared. This is because, if a turn-on signal is applied before the radio frequency signal REF is completely disappeared, the radio frequency signal REF does increase from a desired level before the disappearance from rather than from "0" volt to shorten a time arriving at the normal state. As seen from FIG. 7, when a turn-on signal is applied in a state in which the radio frequency signal REF is not disappeared completely by the turn-off signal, a rising time is reduced into 0.25 $\mu$s which is a half of the conventional rising time (i.e., 0.5 $\mu$s). Herein, an absolute time as indicated in FIG. 6 and FIG. 7 is not critical because it may be changed depending on a load amount of the PDP and an experimental environment, but is comparatively indicated for the purpose of explaining an effect of the switching method according to an embodiment of the present invention.

Figure 8:
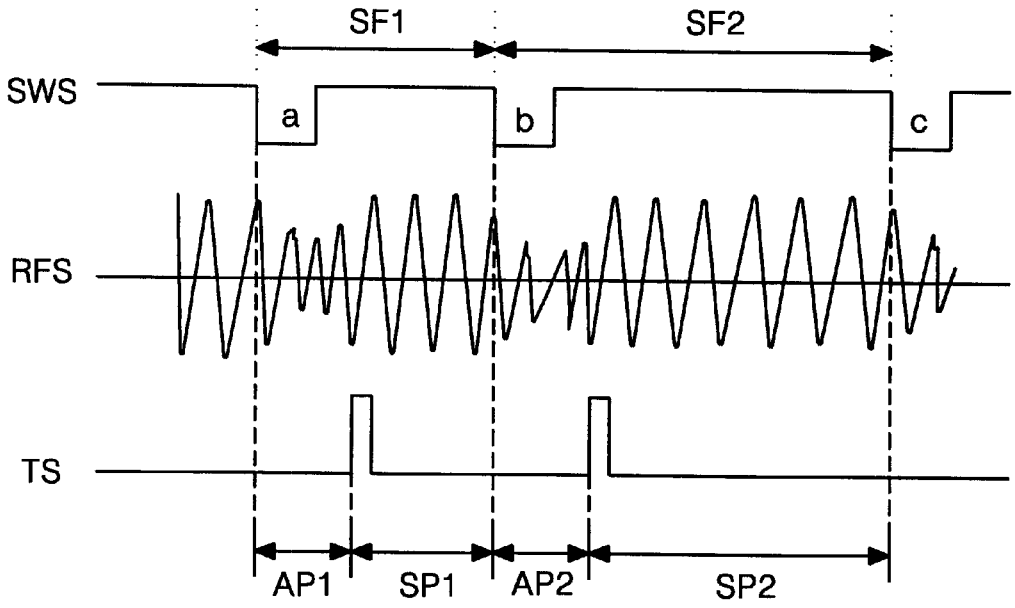
FIG. 8 CONVENTIONAL ART
FIG. 8 is waveform diagrams of driving signals generated by a PDP radio frequency signal switching method according to an embodiment of the present invention.

FIG. 8 shows driving waveforms of the PDP to which the above-mentioned radio frequency switching method is applied. First, a first turn-off signal a is applied to the switch 32 shown in FIG. 4 as the switching signal SWS at a start time of an address interval AP1 of the first sub-field SF1 to erase a radio frequency signal applied in the discharge-sustaining interval of the previous sub-field. Accordingly, a radio frequency discharge sustained in the discharge-sustaining interval at the previous sub-field is terminated. In the address interval AP1, the PDP selects discharge cells to be displayed from the first sub-field SF1. A high level of turn-on signal is applied before the radio frequency signal RFS is disappeared by the first tun-off signal a in such an address interval AP1 to start the radio frequency signal REF for providing a radio frequency discharge of the first sub-field SF1. In this case, the radio frequency signal REF arrives at the normal state within a faster time. A high level of triggering signal TS is applied to the scanning electrode 20 at a time when the radio frequency signal REF arrives at the normal state, that is, a start time of the discharge-sustaining interval SP1, thereby generating a trigger discharge. A radio frequency discharge is initiated with charged particles generated by this triggering discharge and is sustained during the discharge-sustaining interval SP1 of the first sub-field SF1. In this case, the radio frequency signal RFS arriving at the normal state has a level unable to initiate the radio frequency discharge for itself. In other words, a process in which the radio frequency signal REF is turned on by the switching signal SWS is a preparation step for providing the display discharge, whereas a real display time is an interval from the application of the triggering signal TS until the application of the turn-off signal. After a second turn-off signal b was applied to terminate the discharge-sustaining interval SP1 of the first sub-field SF1, the radio frequency signal RFS is again turned on before the radio frequency signal RFS is disappeared as mentioned above to thereby initiate the radio frequency discharge at a desired time.

As described above, in the radio frequency signal switching method according to the present invention, a turn-on signal is applied before the radio frequency signal is completely erased by a turn-off signal, so that a rising time of the radio frequency signal can be reduced. Accordingly, the radio frequency signal switching method according to the present invention is capable of easily implementing a gray scale required by the PDP by switching the radio frequency signal rapidly.

As a radio frequency signal switching method according to another embodiment is proposed a method of more efficiently switching a radio frequency signal without controlling a radio frequency signal generating circuit directly. In other words, in the radio frequency signal switching method according to anther embodiment of the present invention, a power of the radio frequency signal is controlled by varying an impedance of the impedance matcher included so as to match an impedance between the radio frequency signal generating circuit and the PDP. Hereinafter, the above-mentioned method will be described in detail.

Figure 1:
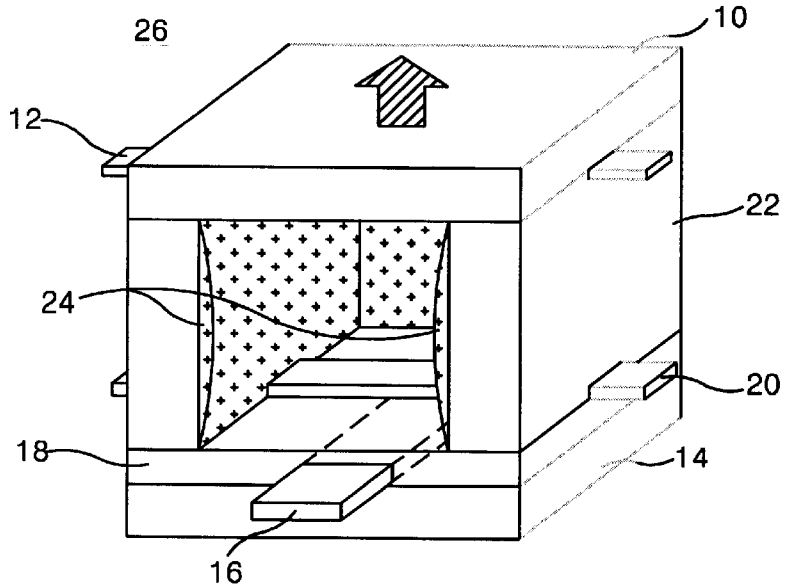
FIG. 1 RELATED ART
FIG. 1 is a perspective view showing the structure of a discharge cell of the conventional radio frequency PDP.
Figure 2:
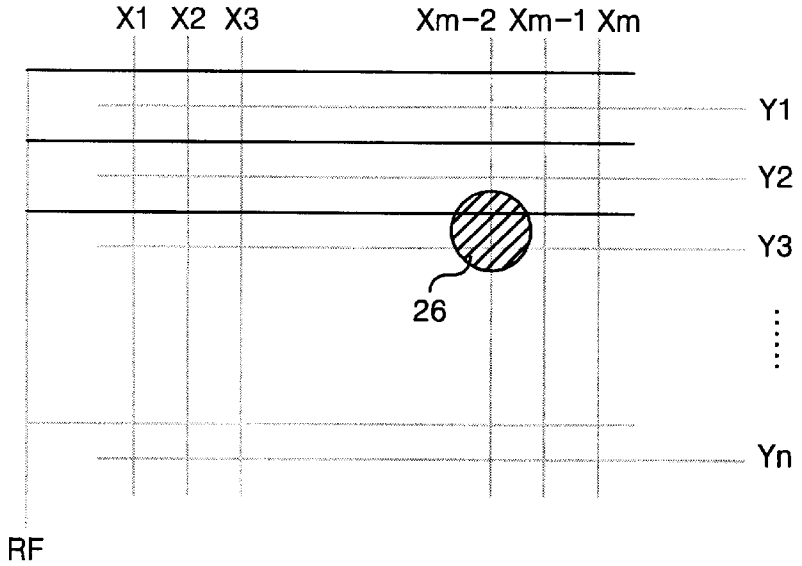
FIG. 2 RELATED ART
FIG. 2 shows an entire electrode arrangement of a radio frequency PDP including the discharge cell of FIG. 1.
Figure 3:
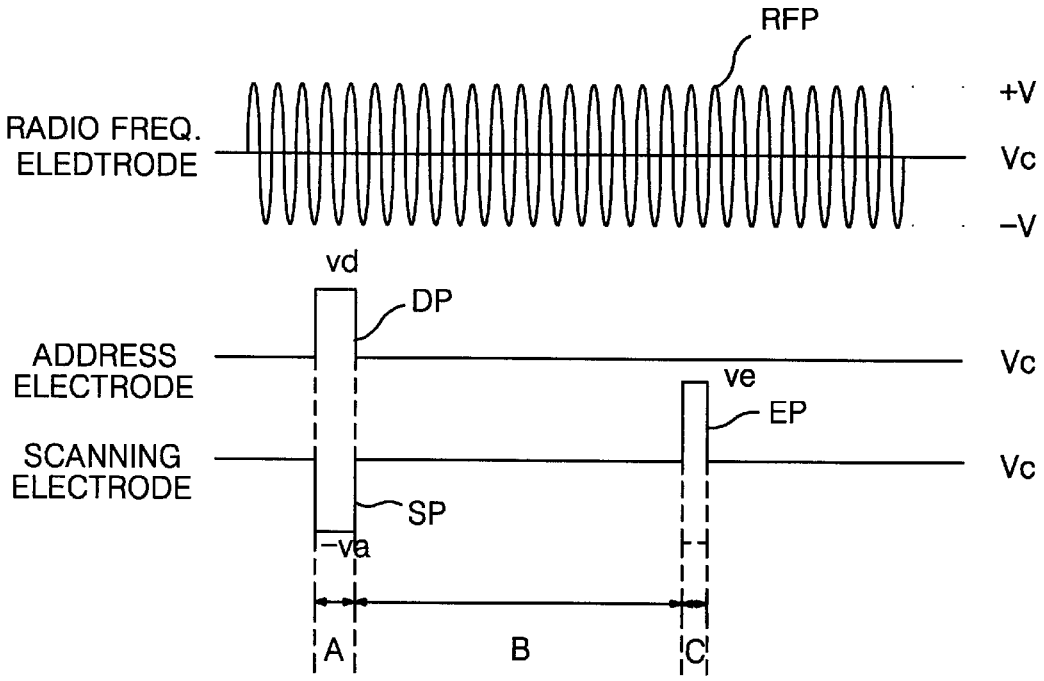
FIG. 3 RELATED ART
FIG. 3 is waveform diagrams of driving signals for driving the discharge cell of FIG. 1.
Figure 4:
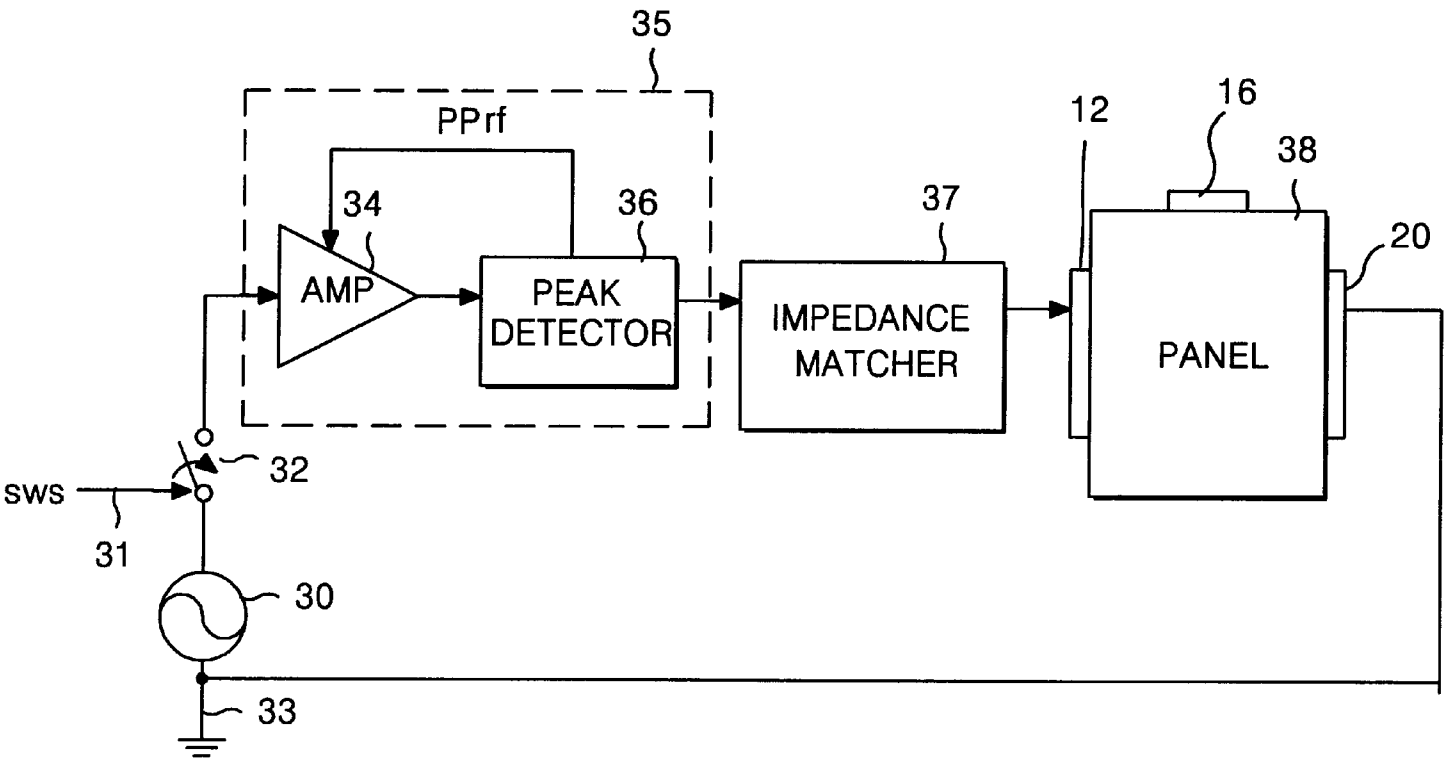
FIG. 4 RELATED ART
FIG. 4 is a block diagram showing the configuration of a radio frequency driving circuit in the conventional radio frequency PDP.
Figure 9:
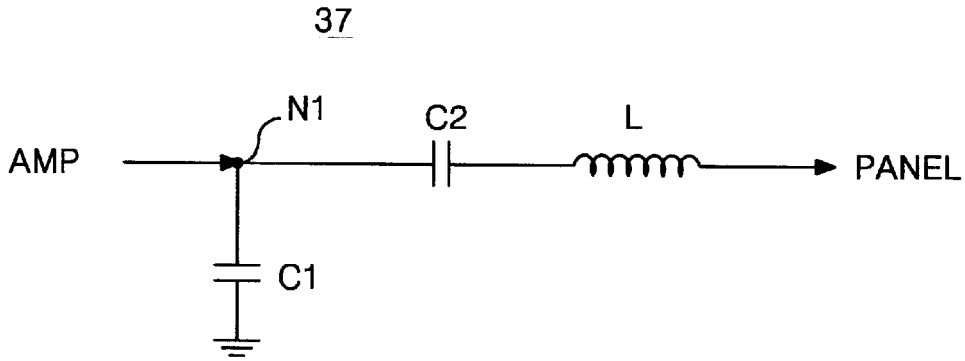
FIG. 9 is a basic circuit diagram of the impedance matcher shown in FIG. 4.

As shown in FIG. 9, the impedance matcher 37 in FIG. 4 includes a first capacitor C1 connected between a first node N1 at The output terminal of the amplifying unit 35 and a ground, and a second capacitor C2 and an inductor L connected, in series, between the first node N1 and the input terminal of the panel 38. An impedance matching of the amplifier 35 with the panel 38 is made by values of the first and second capacitors C1 and C2 and the inductor L. In this case, the values of the first and second capacitors C1 and C2 and the inductor L are fixedly set to optimum values in accordance with an impedance of the panel 38 and a characteristic of the entire PDP system. Herein, an influence that the values of the first and second capacitors C1 and C2 exert on the PDP system becomes different. Particularly, a varying amount of the second capacitor C2 as a serial capacitor has a large influence on the PDP system. In other words, a power of the applied radio frequency signal is changed at a large width (i.e., hundreds of volt) in accordance with a minute change amount (e.g., a change amount of tens of pF) of the second capacitor C2. Thus, if a value of the second capacitor C2 in the impedance matcher 37 is varied, then a power of the radio frequency signal can be controlled without a direct control of main signal lines for the radio frequency signal.

Figure 10:
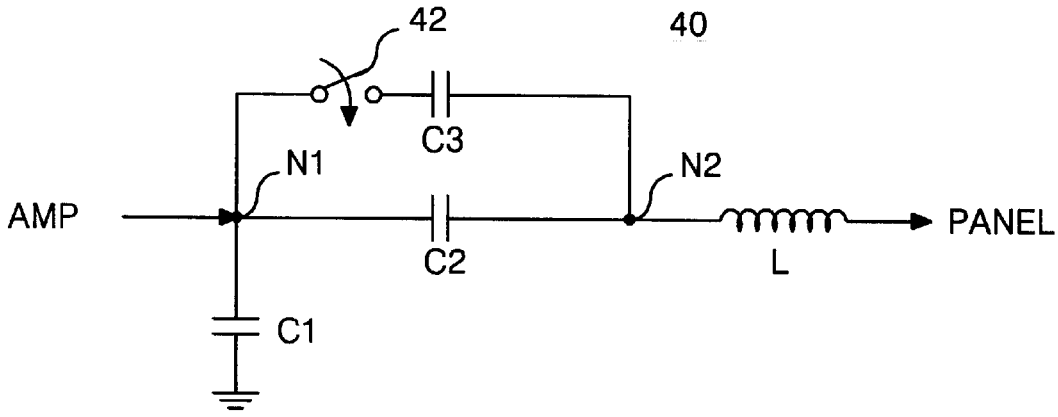
FIG. 10 is a circuit diagram of the radio frequency signal switching circuit according to an embodiment of the present invention.

Referring now to FIG. 10, there is shown a radio frequency signal switching circuit, that is, an impedance matching circuit according to another embodiment of the present invention. The impedance matcher 40 of FIG. 10 includes a first capacitor C1 connected between a first node N1 at the output terminal of the amplifier 35 and a ground, second and third capacitors C2 and C3 connected, in parallel, between the first node N1 and a second node N2, a switch 42 connected between the first node N1 and the third capacitor C3, and an inductor L connected between the second N2 and the input terminal of the panel 38. Herein, it is assumed that, when the panel 38 is normally operated with a radio frequency signal, the amplifier 35 and the panel 38 are impedance-matched by the designed values of the first and second capacitors C1 and C2 and the inductor L. In this case, the radio frequency signal can be switched by selectively connecting the third capacitor C3 to the second capacitor C2 in parallel using the switch 42. More specifically, when the switch 42 is turned, on to connect the third capacitor C3 to the second capacitor C2 in parallel in order to turn off the radio frequency signal, a value of the serial capacitor changes from C2 into C3 to change the entire impedance value. A reflective wave is increased while an incident wave is relatively reduced because an impedance of the amplifier 35 is not matched with that of the panel 38 due to such an impedance change of the matching circuit, so that an effect equal to turning-off of the radio frequency signal can be obtained. As described above, since the serial capacitance has a large influence on an impedance change of the impedance matcher 40 even with a minute variation amount, the radio frequency signal can be switched by changing a value of the serial capacitance.

On the other band, when it is intended to turn, on the radio frequency signal, a radio frequency signal with a maximum power is applied to the panel 38 because the impedance matcher 40 consists of the first and second capacitors C1 and C2 and the inductor L by turning off the switch 42 to match an impedance of the amplifier 35 with that of the panel 38. Since the serial capacitance has a large influence on the impedance change even with a minute variation amount as mentioned above, a value of the second capacitor C2 is set to be larger than that of the third capacitor C3. In this case, since most radio frequency signal is transferred via the second capacitor C2 even though the circuit operates including the third capacitor C3 because a value of the second capacitor C2 is much larger than that of the third capacitor C3, an operation of switching only the third capacitor C3 does not have a significant influence on the PDP system. influence on the PDP system. In other words, a power of the applied radio frequency signal is changed at a large width (i.e., hundreds of volt) in accordance with a minute change amount (e.g., a change amount of tens of pF) of the second capacitor C2. Thus, if a value of the second capacitor C2 in the impedance matcher 37 is varied, then a power of the radio frequency signal can be controlled without a direct control of main signal lines for the radio frequency signal.

Referring now to FIG. 10, there is shown a radio frequency signal switching circuit, that is, an impedance matching circuit according to another embodiment of the present invention. The impedance matcher 40 of FIG. 10 includes a first capacitor C1 connected between a first node N1 at the output terminal of the amplifier 35 and a ground, second and third capacitors C2 and C3 connected, in parallel, between the first node N1 and a second node N2, a switch 42 connected between the first node N1 and the third capacitor C3, and an inductor L connected between the second node N2 and the input terminal of the panel 36. Herein, it is assumed that, when the panel 38 is normally operated with a radio frequency signal, the amplifier 35 and the panel 38 are impedance-matched by the designed values of the first and second capacitors C1 and C2 and the inductor L. In this case, the radio frequency signal can be switched by selectively connecting the third capacitor C3 to the second capacitor C2 in parallel using the switch 42. More specifically, when the switch 42 is turned on to connect the third capacitor C3 to the second capacitor C2 in parallel in order to turn off the radio frequency signal, a value of the serial capacitor changes from C2 into C3 to change the entire impedance value. A reflective wave is increased while an incident wave is relatively reduced because an impedance of the amplifier 35 is not matched with that of the panel 38 due to such an impedance change of the matching circuit, so that an effect equal to turning-off of the radio frequency signal can be obtained. As described above, since the serial capacitance has a large influence on an impedance change of the impedance matcher 40 even with a minute variation amount, the radio frequency signal can be switched by changing a value of the serial capacitance.

On the other hand, when it is intended to turn on the radio frequency signal, a radio frequency signal with a maximum power is applied to the panel 38 because the impedance matcher 42 consists of the first and second capacitors C1 and C2 and the inductor L by turning off the switch 42 to match an impedance of the amplifier 35 with that of the panel 38. Since the serial capacitance has a large influence on the impedance change even with a minute variation amount as mentioned above, a value of the second capacitor C2 is set to be larger than that of the third capacitor C3. In this case, since most radio frequency signal is transferred via the second capacitor C2 even though the circuit operates including the third capacitor C3 because a value of the second capacitor C2 is much larger than that of the third capacitor C3, an operation of switching only the third capacitor C3 does not have a significant influence on the PDP system.

Otherwise, the radio frequency signal may be operated by a method of allowing the second and third capacitors C2 and C3 to be operated by turning on the switch 42 upon normal application of the radio frequency signal; while opening the third capacitor C3 by turning off the switch 42 upon turning-off of the radio frequency signal. Also, the radio frequency signal may be operated by connecting other capacitor, via the switch, to the first capacitor C1 in parallel to switch the switch.

Figure 5:
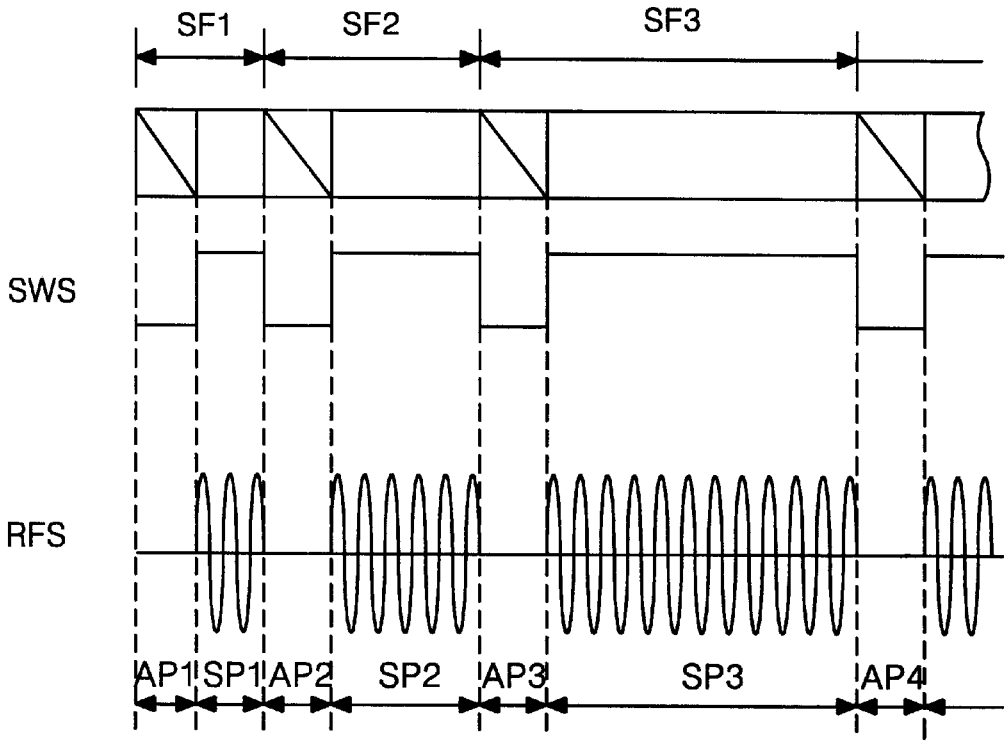
FIG. 5 RELATED ART
FIG. 5 is a view for explaining an ideal radio frequency signal switching method for implementing the gray scale of PDP.
Figure 11:
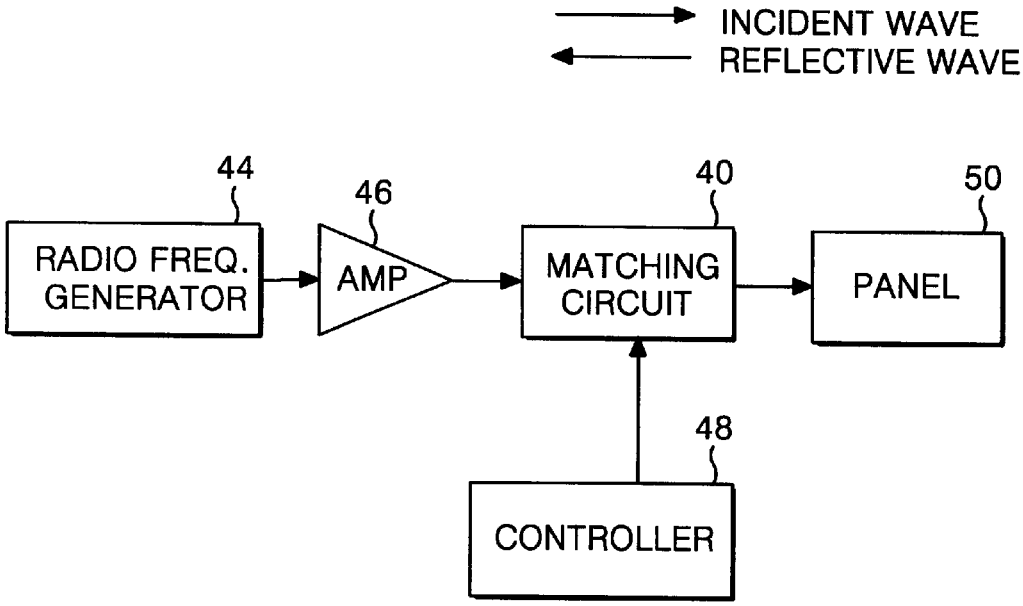
FIG. 11 is a block diagram showing the configuration of the PDP radio frequency driving circuit including the radio frequency signal switching circuit in FIG. 10.

Referring to FIG. 11, there is shown a PDP radio frequency driving circuit according to an embodiment of the present invention including the impedance matcher 40 of the FIG. 10. The PDP radio frequency driving circuit includes a radio frequency generator 44 for generating a radio frequency signal, an amplifier 46 for amplifying the radio frequency signal from the radio frequency generator 44, an impedance matcher 40 connected between the amplifier 46 and a panel 50 to make an impedance matching therebetween and to switch the radio frequency signal, and a controller 48 for applying a switching signal to the impedance matcher 40. The amplifier 46 amplifies the radio frequency signal generated from the radio frequency generator 44 into a power enough to cause a radio frequency discharge, and outputs the same to the impedance matcher 40. The impedance matcher 40 matches an impedance of the amplifier 46 with that of the panel 50 to apply a maximum power of radio frequency signal to the panel 50. The impedance matcher 40 changes an impedance in accordance with a switching signal inputted from the controller 48 as mentioned above to switch the radio frequency signal. The controller 48 applies the switching signal to the impedance matcher 40 at a switching (i.e., on/off) time of the radio frequency signal as shown in FIG. 5 to switch the radio frequency signal.

As described above, according to the present invention, the radio frequency signal is switched by an impedance change in the impedance matching circuit without a direct control of a main circuit for the radio frequency signal to thereby overcome a delay problem at a circuit such as the conventional rising time, so that a display time for the implementation of gray scale can be sufficiently assured.

As a radio frequency signal switching method according to still another embodiment is proposed a method of more efficiently switching a radio frequency signal by controlling a ground line of the radio frequency circuit instead of a main signal line thereof. Hereafter, the above-mentioned method will be described in detail.

Figure 12:
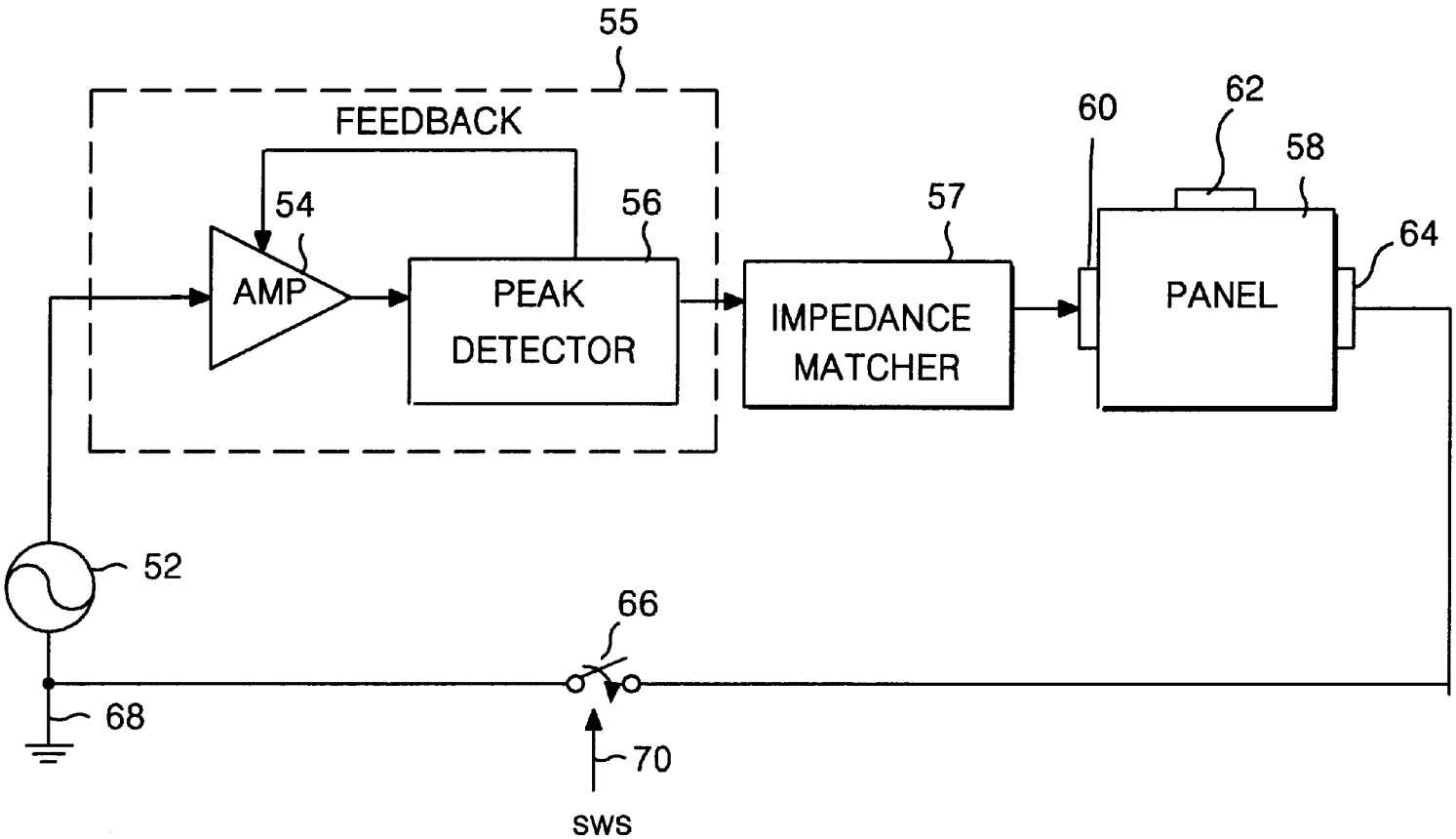
FIG. 12 is a block diagram showing the configuration of a PDP radio frequency driving circuit according to another embodiment of the present invention.

Referring to FIG. 12, there is shown a PDP radio frequency driving circuit according to still an embodiment of the present invention. The PDP radio frequency driving circuit includes a radio frequency generator 52 for generating a radio frequency signal, an amplifying unit 55 for amplifying the radio frequency signal from the radio frequency generator 52, an impedance matcher 57 connected between the amplifying unit 55 and a panel 58 to match an impedance of the amplifying unit 55 with that of the panel, and a switch 66 connected between a ground line 68 connected to the radio frequency generator 52 and a scanning electrode 64 of the panel 58. The radio frequency generator 52 generates a low level of radio frequency pulse and outputs it to the amplifying unit 55. The amplifying unit 55 consists of an amplifier 54 and a peak detector 56. The amplifier 54 amplifies the radio frequency pulse from the radio frequency generator 52 into a power required for a radio frequency discharge and outputs it. The peek detector 56 detects a peak-to-peak value PPrf from the radio frequency pulse from the amplifier 54 and feeds back the same into the amplifier 54, thereby allowing the amplifier 54 to amplify and output the radio frequency pulse into a constant power. The impedance matcher 57 matches an impedance of the output terminal of the amplifying unit 55 with that of the panel 58 to apply maximum power of radio frequency signal to the radio frequency electrode 60. In the panel 58, the scanning electrode 64 is connected to the ground line 68 of the radio frequency generator 52 to be used as a relative electrode of the radio frequency electrode 60. The switch 66 Switches the ground line 68 into the radio frequency circuit to thereby switch the radio frequency signal. In other words, when the switch 66 is turned on by a switching signal SWS inputted via an, input line 70, a radio frequency circuit is constructed. Accordingly, the radio frequency pulse generated from the radio frequency generator 52 is applied to the radio frequency electrode 60 of the panel 58, thereby generating a radio frequency discharge at the discharge cells in which an address discharge is generated between a data electrode 62 and a scanning electrode 64. On the other hand, if the switch 66 is turned off by the switching signal SWS, the radio frequency circuit is opened to prevent the radio frequency signal from being applied to the radio frequency electrode 60 of the panel 58. In other words, if the radio frequency circuit is opened by the turning-off of the switch 66, then, an impedance of the panel 58 viewed at the side of the amplifying unit 55 is varied to change a power level of the radio frequency signal, so that the radio frequency signal is not applied to the radio frequency electrode 60. Thus, a radio frequency discharge having been generated earlier and sustained is stopped. As described above, when the ground line 68 of the radio frequency circuit is opened by means of the switch 66, the radio frequency signal applied to the radio frequency electrode 60 is not turned off, but a power level of the radio frequency signal is dramatically decreased, thereby stopping the radio frequency discharge. Subsequently, if the switch 66 is turned on, then the radio frequency pulse is returned into the original, power level to be applied to the radio frequency electrode 60, thereby generating the radio frequency discharge. In this case, since the radio frequency signal is not amplified from a low level (i.e., off state) again, a delay of the rising time is not generated.

As described above, according to the present invention, the radio frequency signal is switched using the ground line instead of the main signal line to thereby overcome a delay problem at the circuit such as the conventional rising time, so that a display time for the implementation of gray scale can be sufficiently assured.

As described above, in the radio frequency switching method of the PDP according to the present invention, a turning-on signal is applied before the radio frequency signal is completely erased by the turning-off signal, so that a rising time of the radio frequency signal can be reduced. Also, the radio frequency driving circuit of the PDP according to the present invention is capable of switching the radio frequency signal without a time delay by changing an impedance in the impedance matching circuit without a direct control of the main circuit for the radio frequency signal. Furthermore, the radio frequency signal is switched using the ground line instead of the main signal line, so that the radio frequency signal can be switched without a time delay such as the conventional rising time. Accordingly, the present invention is capable of sufficiently assuring a display time for the implementation of gray scale required by the PDP by switching the radio frequency signal rapidly. As a result, according to the present invention, the radio frequency signal is switched to be applied to the panel only in the display interval, so that the PDP employing a radio frequency signal can be stabbly driven.

Although the present invention has been explained by the embodiments shown in the drawings described above, it should be understood to the ordinary skilled person in the art that the invention is not limited to the embodiments, but rather that various changes or modifications thereof are possible without departing from the spirit of the invention. Accordingly, the scope of the invention shall be determined only by the appended claims and their equivalents.

What is claimed is:

1. The driving circuit for a plasma display panel using a radio frequency discharge, comprising:

radio frequency generating means for generating a radio frequency signal;

impedance matching means for matching an impedance of the radio frequency generating means with that of the plasma display panel and varying the matched impedance to switch the radio frequency signal; and control means for applying a switching signal of the radio frequency signal according to an interval of the radio frequency discharge to the impedance matching means.

2. The driving circuit as claimed in claim 1, further comprising:

amplifying means for amplifying the radio frequency signal from the radio frequency generating means into a power enough to cause the radio frequency discharge.

3. The driving circuit as claimed in claim 1, wherein said impedance matching means varies a value of a serial capacitor thereof in accordance with the switching signal to switch the radio frequency signal.

4. The driving circuit as claimed in claim 3, wherein said impedance matching means varies said value of the serial capacitor by selectively connecting a second capacitor to the serial capacitor in parallel in accordance with the switching signal.

5. The driving circuit as claimed in claim 4, wherein a value of the serial capacitor is set to be sufficiently larger than that of the second capacitor.

6. A method of switching a radio frequency signal used for a radio frequency discharge in a plasma display panel employing the radio frequency discharge, comprising:

controlling a power level of the radio frequency signal applied to the plasma display panel by switching the radio frequency signal; and varying an impedance of the plasma display panel in accordance with an interval of the radio frequency discharge to control the power level of the radio frequency signal.

7. A method of switching a radio frequency signal used for a radio frequency discharge in a plasma display panel employing the radio frequency discharge, comprising:

controlling a power level of the radio frequency signal applied to the plasma display panel by switching the radio frequency signal;

varying an impedance of the plasma display panel in accordance with an interval of the radio frequency discharge to control the power level of the radio frequency signal, wherein said impedance of the plasma display panel is varied by switching a ground line of a radio frequency circuit connected to the plasma display panel.

8. A driving circuit for a plasma display panel using a radio frequency discharge, comprising:

radio frequency generating means for generating a radio frequency signal to apply it to a radio frequency electrode of the plasma display panel; and switching means connected between other electrode of the plasma display panel connected to a ground line of the radio frequency generating means and the ground line to be switched in accordance with an interval of the radio frequency discharge, thereby controlling a power level of the radio frequency signal applied to the radio frequency electrode.

9. A method of controlling a plasma display panel device in which an address discharge for selecting cells to be displayed is made by a current voltage applied to crossing electrodes while a sustaining discharge for sustaining said discharge of the selected cells to provide a display is made by a radio frequency voltage, wherein said radio frequency voltage is turned on or off by a switching pulse to be turned on only in the sustaining-discharge interval; and said switching pulse applies a turning-on signal before the radio frequency signal is completely erased by applying a turning-off signal.

10. The method as claimed in claim 9, wherein a normal-state voltage of the radio frequency voltage applied to the plasma display panel is set to be lower than an initiation voltage of the radio frequency discharge.

11. The method as claimed in claim 10, wherein a triggering signal for initiating the radio frequency discharge is further applied to the plasma display panel.

* * * * *